US006722232B1

(12) United States Patent
Day

(10) Patent No.: US 6,722,232 B1
(45) Date of Patent: Apr. 20, 2004

(54) MANUALLY-POWERED DRIVE DEVICE AND ASSEMBLY

(75) Inventor: Kevin D. Day, Old Tappan, NJ (US)

(73) Assignee: CRT Enterprises, Inc., Old Tappan, NJ (US)

( * ) Notice: Subject to any disclaimer, the term of this patent is extended or adjusted under 35 U.S.C. 154(b) by 0 days.

(21) Appl. No.: 10/211,169

(22) Filed: Aug. 1, 2002

(51) Int. Cl.[7] ..... B25B 17/00

(52) U.S. Cl. ..... 81/57.28; 81/56; 81/57; 81/57.22; 81/57.29; 81/57.39; 81/58.1

(58) Field of Search ..... 81/56, 57, 57.22, 81/57.29, 57.28, 57.15, 57.39, 58.1

(56) References Cited

U.S. PATENT DOCUMENTS

| | | | | |
|---|---|---|---|---|
| 3,519,046 A | | 7/1970 | Pierce | |
| 3,941,017 A | | 3/1976 | Lenker et al. | |
| 4,141,262 A | | 2/1979 | Smith | |
| 4,249,617 A | | 2/1981 | Cox, Jr. | |
| 4,524,650 A | | 6/1985 | Marks | |
| 4,970,918 A | | 11/1990 | Brewer et al. | |
| 5,289,731 A | * | 3/1994 | Womack | 74/133 |
| 5,363,726 A | * | 11/1994 | Smith | 81/57.29 |
| 5,584,220 A | | 12/1996 | Darrah et al. | |
| 5,911,722 A | | 6/1999 | Adler et al. | |
| 5,931,061 A | * | 8/1999 | Kuo | 81/57.29 |
| 6,053,080 A | | 4/2000 | Kaneyama et al. | |
| 6,089,331 A | | 7/2000 | Christ | |
| 6,112,621 A | * | 9/2000 | Ochiai | 81/57.29 |
| 6,216,562 B1 | | 4/2001 | Hsieh | |

* cited by examiner

*Primary Examiner*—Joseph J. Hail, III
*Assistant Examiner*—Alvin J. Grant
(74) *Attorney, Agent, or Firm*—Schmeiser, Olsen & Watts

(57) ABSTRACT

A manually-powered drive device includes a drive train substantially disposed in a hollow housing. A laterally sliding transmission shaft extending laterally in an intermediate frame portion of the housing includes first and second circumferential recesses. A transmission selector spring flexes and removably slidably couples within the first circumferential recess or the second circumferential recess as the transmission shaft laterally slides between alternate positions, thereby selecting the desired rotational direction for manipulating fasteners. Another manually-powered drive device includes a first drive assembly extending coaxially in the barrel portion of the housing and a second drive assembly extending in the intermediate frame portion of the housing between any acute angle and any obtuse angle to the first drive assembly. A manually-powered drive device assembly includes a manually-powered drive device removably coupled with a removable attachment tool configured to transmit motion and driving force to a fastener for manipulation.

17 Claims, 11 Drawing Sheets

MANUALLY-POWERED DRIVE DEVICE AND ASSEMBLY

BACKGROUND OF THE INVENTION

1. Technical Field

This invention relates to the field of hand tools. More specifically, the invention relates to a manually-powered drive device and assembly.

2. Background Art

Hand tools, such as wrenches, socket wrenches, screw drivers, and the like, are available, but often are not able to be used in places having a minimum amount of excess space and where speed or torque is desirable. Manually driven tools are also available and they vary in type. One type of manually driven tool is the plier-like ratchet wrenches. Like pliers, they require a sideways squeeze when engaged with a fastener, and to reverse direction, they must be flipped over and re-engaged with the fastener. Most of the other manually driven hand tools have been heavy, bulky and complex in construction and, hence, have been expensive to produce and have required considerable maintenance. Furthermore, these other types of manually driven tools have only a single drive and are therefore, not versatile and adjustable to a variety of places, orientations, and applications.

Electrically and pneumatically driven tools are common and may offer speed and other advantages over manually driven tools. However, where electrical or pneumatic power is unavailable, such power drivers cannot be used and such advantages cannot be realized. Furthermore, these power drivers suffer from the same problems that afflict manually driven hand tools. That is, these power drivers have been heavy, bulky and complex in construction and, hence, have been expensive to produce and have required considerable maintenance. Additionally, these power drivers often are not able to be used in places having a minimum amount of excess space. Furthermore, these power drivers have only a single drive and are therefore, not versatile and adjustable to a variety of places, orientations, and applications.

DISCLOSURE OF THE INVENTION

Accordingly, what is needed is a drive device that is manually-powered and overcomes the aforementioned drawbacks of previous hand, manually driven, and electrically and pneumatically driven tools, such as the inability to be used in places having a minimum amount of excess space and where speed or torque is desirable, and the inability to adjust to a variety of places, orientations, and applications due to only a single drive. The invention solves these problems through a manually-powered drive device and assembly.

In association with an embodiment of the present invention, a manually-powered drive device may include a pistol-shaped, hollow housing including a barrel portion and a hand grip portion separated by an intermediate frame portion, the barrel portion and the hand grip portion extending substantially perpendicularly from one another. A drive train may be substantially disposed within the pistol-shaped housing to transmit motion and driving force, and may include a transmission assembly including a transmission shaft extending laterally in the intermediate frame portion and including first and second circumferential recesses, the transmission shaft configured to laterally slide between alternate positions. Also included, a transmission selector spring may include a protrusion for one end portion thereof, the protrusion configured to flex and removably slidably couple within the first circumferential recess or the second circumferential recess as the transmission shaft laterally slides between alternate positions, thereby selecting the desired rotational direction for manipulating fasteners.

In association with an embodiment of the present invention, a manually-powered drive device may include a pistol-shaped, hollow housing including a barrel portion and a hand grip portion separated by an intermediate frame portion, the barrel portion and the hand grip portion extending substantially perpendicularly from one another. A drive train may be substantially disposed within the pistol-shaped housing to transmit motion and driving force, and may include a first drive assembly extending coaxially in the barrel portion of the housing along a substantial portion of its length and a second drive assembly extending in the intermediate frame portion between any acute angle and any obtuse angle to the first drive assembly.

In association with an embodiment of the present invention, a manually-powered drive device assembly may include a manually-powered drive device removably coupled with a removable attachment tool configured to transmit motion and driving force to a fastener for manipulation.

One advantage of embodiments of the invention may be that they allow for the installing and removing of fasteners in places having a minimum amount of excess space not accessible with conventional wrenches, socket wrenches, screw drivers, manually driven tools, electrically and pneumatically driven tools, and the like, and where speed or torque is desirable. Another advantage of other embodiments of the invention may be the inclusion of twin drive puck assemblies that may allow, for example, an attached wand assembly of the invention to be placed in at least four different orientations to facilitate the installing and removing of fasteners in a variety of places, orientations, and applications. Other advantages of the invention are its simple and compact design, rugged construction, ease of use, and efficiency in operation.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings, where like designations denote like elements.

DETAILED DESCRIPTION OF THE INVENTION

Figure 1:
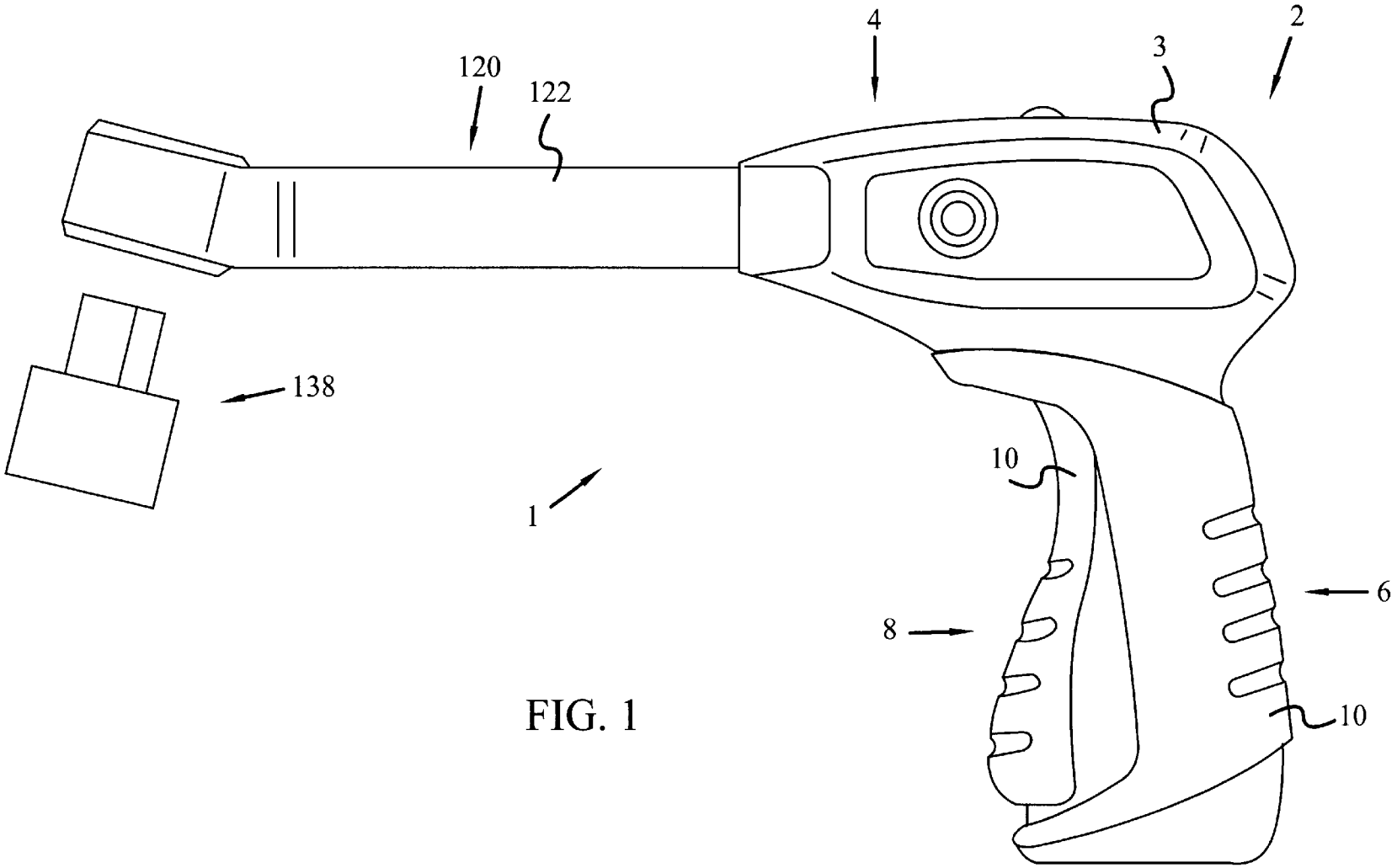
FIG. 1 is a side plan view of a manually-powered drive device assembly embodiment of the invention including a manually-powered drive device embodiment of the invention and a removable wand assembly embodiment of the invention in operative conjunction with one another.

It will be understood by those of ordinary skill in the art that the invention is not limited to the specific structures illustrated in the drawings. Accordingly, for example, although particular gears, plates, shafts, springs, spacers, rings, keyways, clips, locks, brackets, pucks, housings, and other components are illustrated in the drawings, such components may comprise any shape, size, style, diameter, radius, ratio, angle, pressure angle, teeth configuration and number, pitch, diametral pitch, bore, resiliency, coil configuration and number, gauge, material, and/or the like as is known in the art for such components consistent with the intended mechanical operation of a manually-powered drive device and assembly of the invention. Moreover, it will also be understood by those of ordinary skill in the art that the invention is not limited to use of any specific components provided that the components selected are consistent with the intended mechanical operation of a manually-powered drive device and assembly of the invention.

Generally, a manually-powered drive device of the invention may comprise a housing having a substantially internal drive train that may comprise a trigger assembly, a clutch assembly, a transmission assembly, a back drive lock assembly, an idler assembly, and/or at least one drive assembly. Accordingly, although the invention may be readily adapted to a variety of embodiments of a manually-powered drive device, with reference to FIG. 1, manually-powered drive device 2 is an example of a manually-powered drive device of the invention.

Manually-powered drive device 2 may generally include housing 3. Housing 3 may be generally pistol-shaped and hollow, and may comprise barrel portion 4 and hand grip portion 6 extending substantially perpendicularly from one another. Hand grip portion 6 may comprise a sleeve portion that slidably receives therein geared trigger 22 of trigger assembly 8 as will hereinafter be described. Hand grip portion 6 may also be contoured for sturdy gripping by the hand of an operator. That is, contoured portions may be valleys defining contours for receiving the palm of an operator. Hand grip portion 6 may also include soft grip overlay 10 to cushion hand grip portion 6. That is, soft grip overlay 10 adds to the comfort of hand grip portion 6 cushioning an operators hand from the hardness and the vibrations of manually-powered drive device 2 when in use.

Describing manually-powered drive device 2 in greater detail and with further reference to FIGS. 2–9, manually-powered drive device 2 may include a drive train substantially disposed within housing 3. The drive train may be retained in operative position within housing 3 by opposing side plates compatible with and coupled to or integral with internal portions of opposing halves of the housing. The side plates may be configured to couple with portions of the drive train to retain the drive train in an operative position within housing 3. Notwithstanding, for the exemplary purposes of this disclosure, internal portions of opposing halves of housing 3 may couple with or be integrally joined with portions of various components of the drive train to retain the drive train in an operative position within housing 3. The drive train may comprise trigger assembly 8, clutch assembly 30, transmission assembly 50, back drive lock assembly 70, idler assembly 90, and at least one drive assembly 100.

Trigger assembly 8 may be configured to slidably move back and forth within the sleeve portion of hand grip portion 6 when squeezed by an operators hand during drive and return strokes. As depicted in FIGS. 1–4, trigger assembly 8 may include trigger shaft 12, torsion trigger spring 14, trigger stop shaft 16, trigger long spacer 18, trigger short spacer 20, and geared trigger 22.

Trigger shaft 12 may be configured to receive torsion trigger spring 14, trigger long spacer 18, trigger short spacer 20, and geared trigger 22 so as to retain them in an operative relationship, as well as to allow geared trigger 22 to pivot thereon between drive and return strokes. For the exemplary purposes of this disclosure, trigger shaft 12 may be a cylindrical shaft, a cylindrical shaft with central apertures defined in opposing ends thereof, or an annularly cylindrical shaft.

Torsion trigger spring 14 may be configured to bias geared trigger 22 in a disengaged position after each drive stroke of geared trigger 22 (i.e., once an applied squeezing force from an operator's hand is removed). In other words, during each return stroke of geared trigger 22, torsion trigger spring 14 automatically returns geared trigger 22 from its engaged position to its disengaged position. For the exemplary purposes of this disclosure, torsion trigger spring 14 fits over and along trigger long spacer 18 and may be close wound with opposing loops or protrusions at each end, one for coupling with geared trigger 22 and the other for coupling with an internal portion of one of the opposing halves of housing 3 for example.

Trigger stop shaft 16 may be configured to limit the displacement of geared trigger 22 as it pivots on trigger shaft 12 between drive and return strokes of geared trigger 22 (i.e., when geared trigger 22 is squeezed by an operators hand and when torsion trigger spring 14 acts on geared trigger 22 respectively). For the exemplary purposes of this disclosure, trigger stop shaft 16 may be a cylindrical shaft, a cylindrical shaft with central apertures defined in opposing ends thereof, or an annularly cylindrical shaft.

Trigger long spacer 18 and trigger short spacer 20 are each configured to position geared trigger 22 to operatively engage with clutch assembly 30 as hereinafter described. For the exemplary purposes of this disclosure, trigger long spacer 18 and trigger short spacer 20 may each be an annularly cylindrical shaft.

Geared trigger 22 may be configured to pivot on trigger shaft 12 and slidably move back and forth within the sleeve portion of hand grip portion 6 between drive and return strokes. For the exemplary purposes of this disclosure, geared trigger 22 has a spatulate lower portion, an intermediate portion, and an angled upper portion. The spatulate lower portion may be configured to slidably move within the sleeve portion of hand grip portion 6 when squeezed by an operators hand. The front portion of the spatulate lower portion of geared trigger 22 may also be contoured for sturdy gripping by the hand of an operator. That is, contoured portions may be valleys defining contours for receiving the fingers of an operator. As depicted in FIG. 1, the front portion of the spatulate lower portion of geared trigger 22 may also include soft grip overlay 10 as previously described. The intermediate portion has an aperture therethrough for receiving trigger shaft 12 so that geared trigger 22 may pivot between drive and return strokes. The angled upper portion may be at an angle from a latitudinal back axis of the spatulate lower portion of approximately 0° to 60°. The angled upper portion has an arcuate transverse slot therethrough for receiving trigger stop shaft 16 so that the displacement of geared trigger 22 as it pivots on trigger shaft 12 between drive and return strokes may be limited. The angled upper portion also has an integral, arcuate gear rack for engaging with clutch assembly 30 as hereinafter described for transmitting motion and driving force on each cycle of movement of geared trigger 22 between drive and return strokes. For the exemplary purposes of this disclosure, the integral, arcuate gear rack may have 6 teeth.

Figure 2:
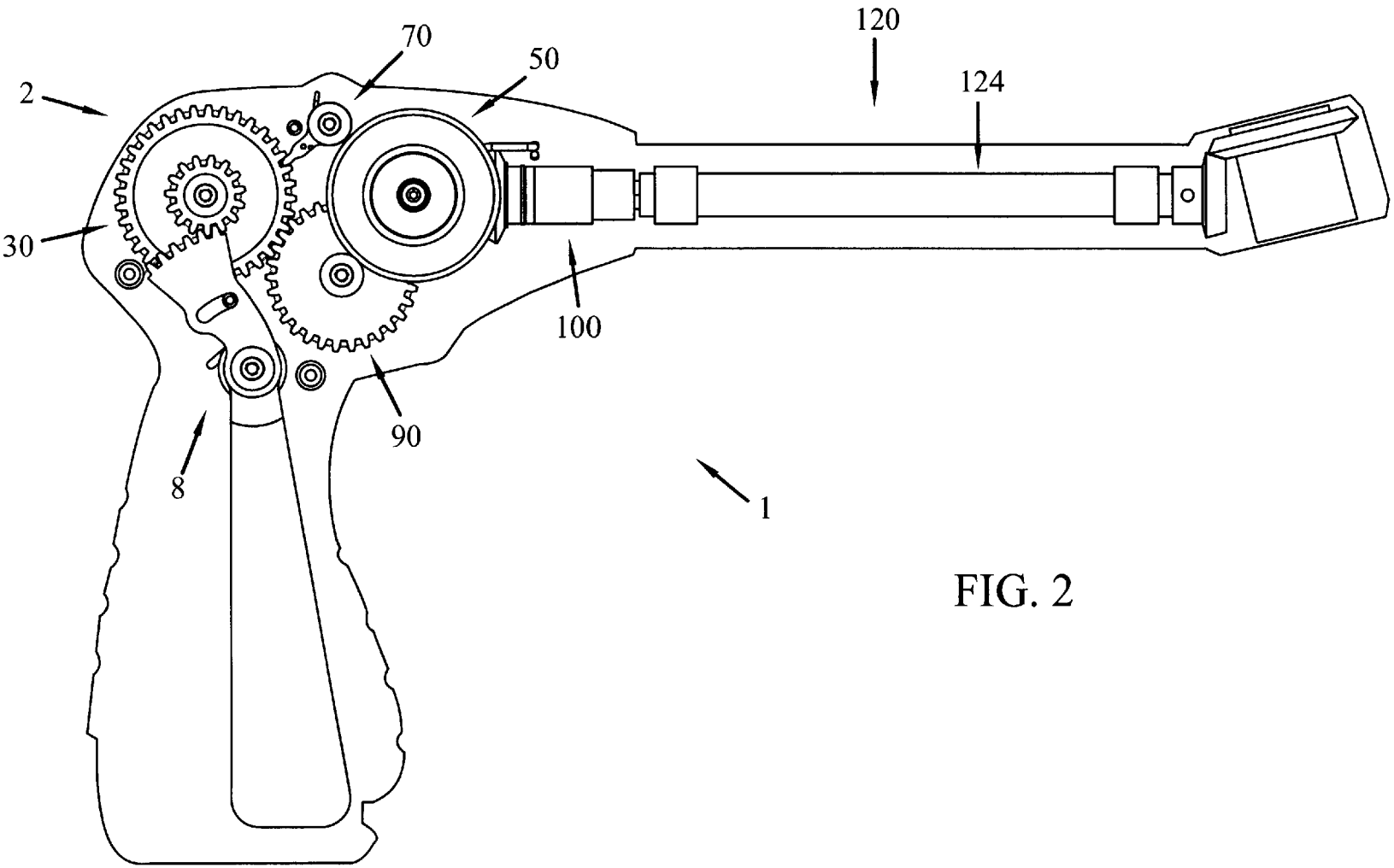
FIG. 2 is a side plan view of the manually-powered drive device assembly of FIG. 1.
Figure 3:
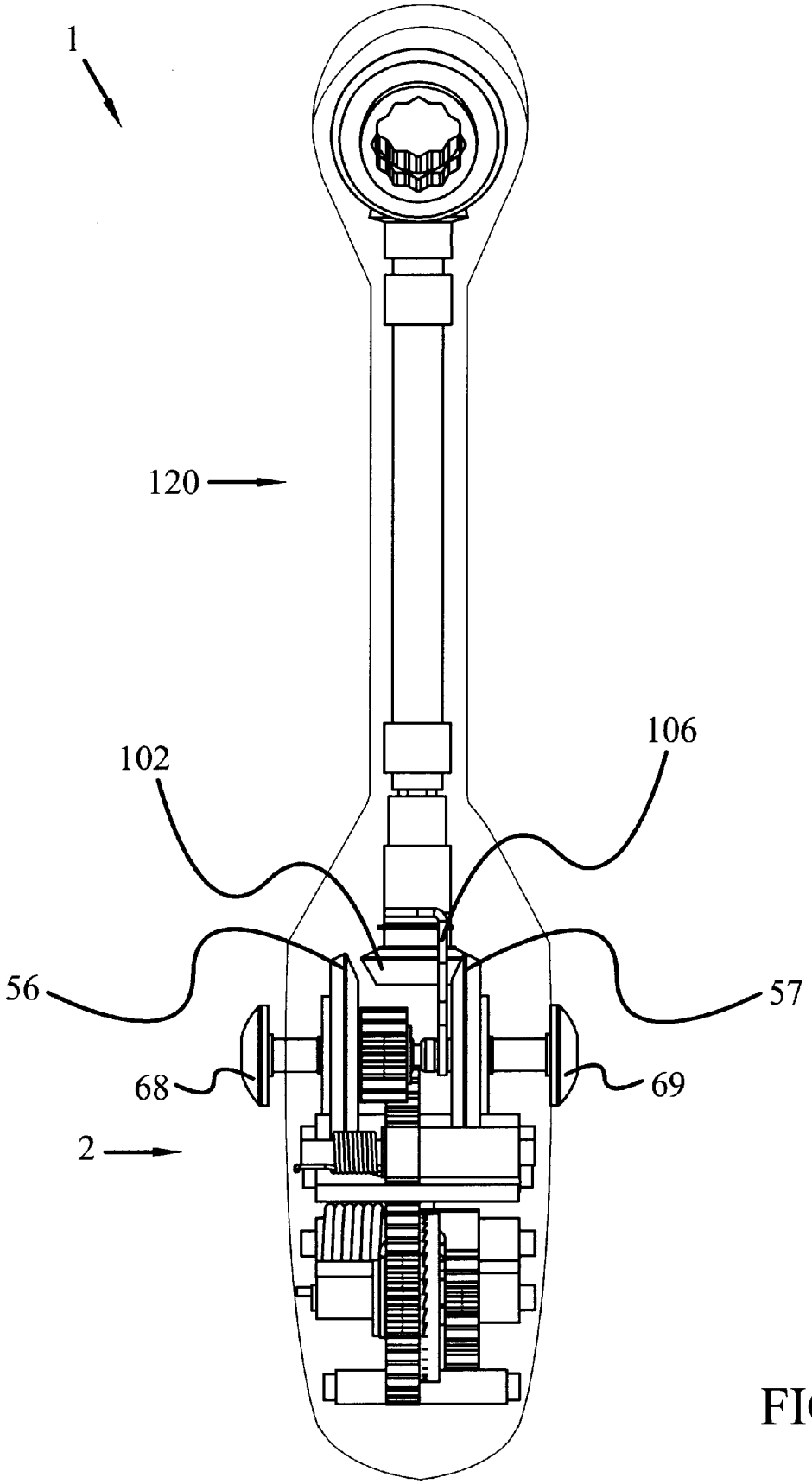
FIG. 3 is a top plan view of the manually-powered drive device assembly of FIG. 1.
Figure 4:
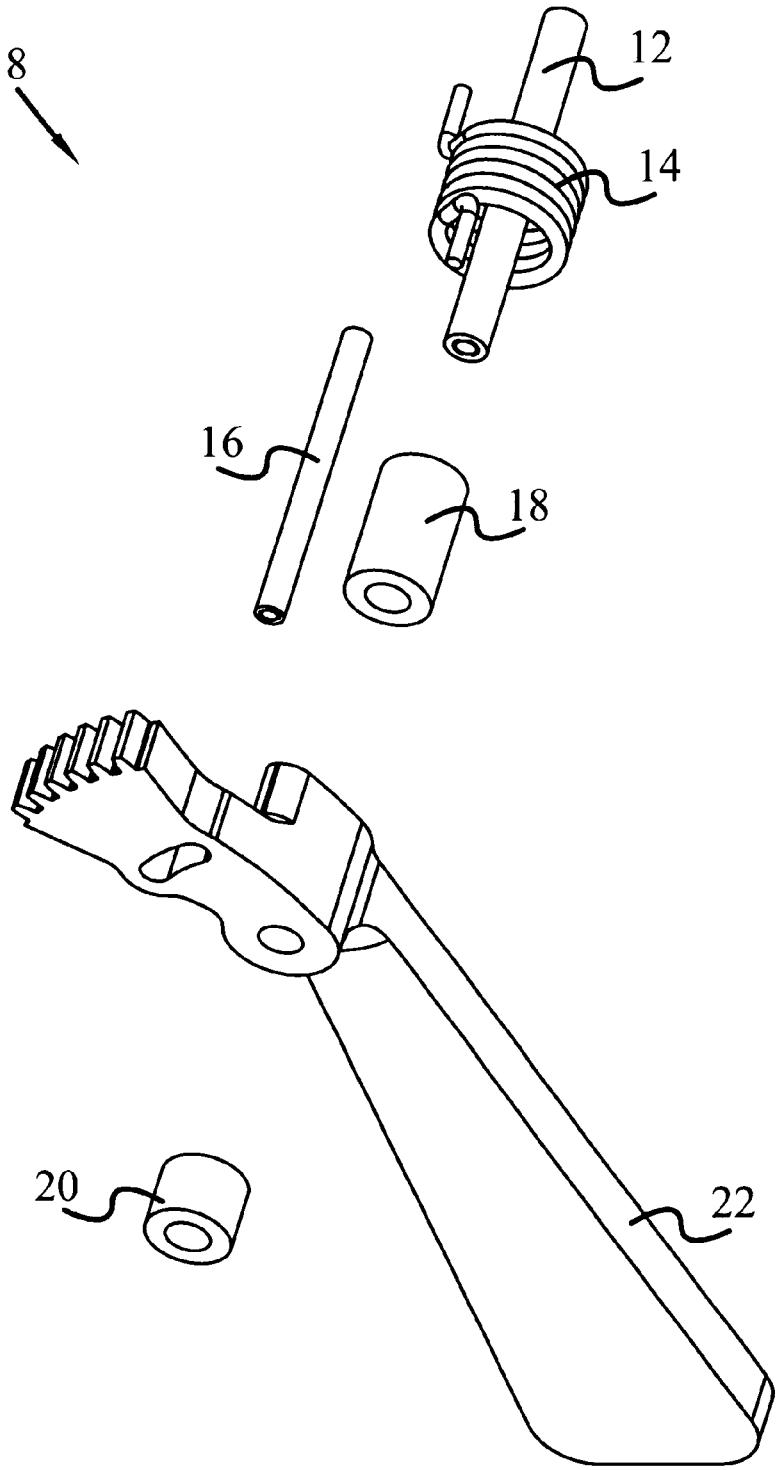
FIG. 4 is an exploded isometric plan view of the trigger assembly of FIGS. 2–3.
Figure 5:
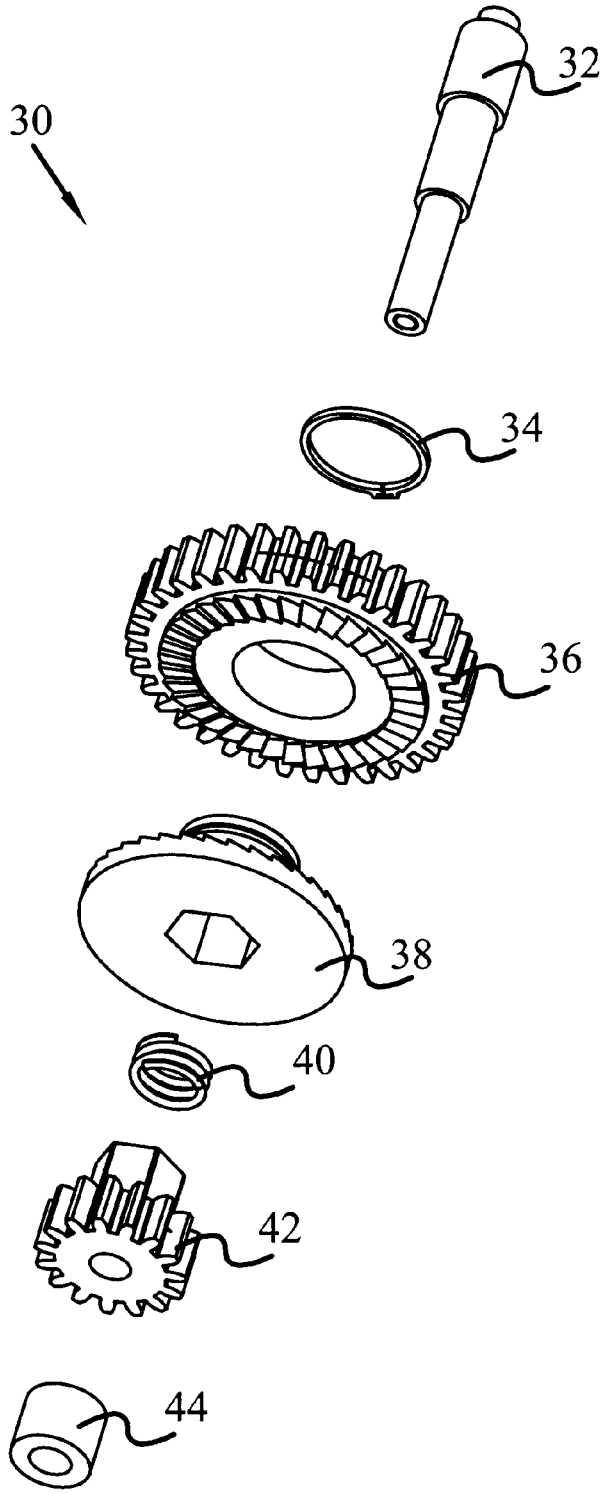
FIG. 5 is an exploded isometric plan view of the clutch assembly of FIGS. 2–3.

Clutch assembly 30 may be configured to provide a locked driving connection for clutch plates 36 and 38 (as hereinafter described) upon rotation of clutch plates 36 and 38 in an engaged direction (e.g. counterclockwise) during a drive stroke of geared trigger 22 and to free clutch plate 38 for detached relative movement upon rotation of clutch plate 38 in a reverse, disengaged direction (e.g. clockwise) during a return stroke of geared trigger 22. Accordingly, the rotation of clutch plate 38 in a reverse, disengaged direction is accomplished without perceptible drag. This is advantageous when driving a relatively free-running fastener and where it is a common experience with ratchet wrenches that the part being driven will be dragged back during the return positioning of the ratchet parts. In manually-powered drive device 2, even a relatively free-running fastener will remain stationary during the rotation of clutch plate 38 in a reverse, disengaged direction, thereby providing a full length advance of the driven fastener on each cycle of movement of geared trigger 22 between drive and return strokes. As depicted in FIGS. 2–3 and 5, clutch assembly 30 may include clutch shaft 32, retaining ring 34, geared clutch plate 36, clutch plate 38, clutch spring 40, spur gear 42, and trigger short spacer 44.

Clutch shaft 32 may be configured to receive retaining ring 34, geared clutch plate 36, clutch plate 38, clutch spring 40, spur gear 42, and trigger short spacer 44 so as to retain them in an operative relationship, as well as to allow spur gear 42, clutch plate 38, and geared clutch plate 36 to pivot thereon between drive and return strokes of geared trigger 22. For the exemplary purposes of this disclosure, clutch shaft 32 may be a cylindrical, three-tiered shaft, a cylindrical, three-tiered shaft with central apertures defined in opposing ends thereof, or an annularly cylindrical, three-tiered shaft. The first, largest tier may be configured to stop the hub of clutch plate 38 as hereinafter described. The second, intermediate tier may be configured to receive thereon clutch plate 38 and geared clutch plate 36. The third, smallest tier may be configured to receive thereon spur gear 42 and trigger short spacer 44.

Retaining ring 34 may be configured to hold geared clutch plate 36 on the hub of clutch plate 38 in an operative relationship. For the exemplary purposes of this disclosure, retaining ring 34 is an external, axial retaining ring such that when it is installed along the center point of the hub of clutch plate 38 into the circumferential channel therein as will hereinafter be described, the portion of retaining ring 34 protruding from the circumferential channel (also called a "shoulder") holds geared clutch plate 36 in place.

Geared clutch plate 36 may be configured to both engage with clutch plate 38 and engage with spur gear 96 of idler assembly 90 as hereinafter described during a drive stroke of geared trigger 22 and to disengage with clutch plate 38 during a return stroke of geared trigger 22. For the exemplary purposes of this disclosure, geared clutch plate 36 may comprise a spur gear with a clutch plate 38 engaging portion on a face thereof and a central, cylindrical aperture for receiving the hub of clutch plate 38. The clutch plate 38 engaging portion may comprise an annular ring having a plurality of wedge-shaped teeth. The spur gear may have a diametral pitch of 24, 36 teeth, and a 1.500 inch pitch diameter.

Clutch plate 38 may be configured to both engage with spur gear 42 and geared clutch plate 36 during a drive stroke of geared trigger 22 and to disengage with geared clutch plate 36 during a return stroke of geared trigger 22. For the exemplary purposes of this disclosure, clutch plate 38 may comprise a plate having a geared clutch plate 36 engaging portion on a face thereof, a hub on the same face thereof, and a two-tiered, central aperture extending through the plate and the hub. The clutch plate 36 engaging portion may comprise an annular ring having a plurality of wedge-shaped teeth. The hub may be cylindrical and may have a circumferential channel in its end portion distal from the geared clutch plate 36 engaging portion for receiving retaining ring 34. The first, larger tier of the central aperture may be rectilinear (e.g. polygonal, such as hexagonal—6 interior corners—or dodecagonal—12 interior corners) for receiving the hub of spur gear 42 as hereinafter described. The second, smaller tier of the central aperture in the distal end portion of the hub may be cylindrical for both receiving the second, intermediate tier of clutch shaft 32 and stopping clutch spring 40 as hereinafter described.

Clutch spring 40 may be configured to bias clutch plate 38 in a disengaged position after each drive stroke of geared trigger 22. In other words, during each return stroke of geared trigger 22, clutch spring 40 automatically returns clutch plate 38 from its engaged position with geared clutch plate 36 (i.e., where the wedge-shaped teeth of both the clutch plate 36 engaging portion and the clutch plate 38 engaging portion are engaged with one another) to its disengaged position (i.e., where the wedge-shaped teeth of both the clutch plate 36 engaging portion and the clutch plate 38 engaging portion are disengaged from one another). For the exemplary purposes of this disclosure, clutch spring 40 is cylindrical helical spring having a first end portion seating within the first, larger tier and against the second, smaller tier of the central aperture in spur gear 42 as hereinafter described and having a second, opposing end portion seating against the second, smaller cylindrical tier of the central aperture of clutch plate 38.

Spur gear 42 may be configured to both engage with the integral, arcuate gear rack of geared trigger 22 and clutch plate 38 for transmitting motion and driving force during drive strokes of geared trigger 22. For the exemplary purposes of this disclosure, spur gear 42 may have a diametral pitch of 24, 15 teeth, and a 0.625 inch pitch diameter. In addition, spur gear 42 may have a rectilinear hub on a face thereof (e.g. polygonal, such as hexagonal—6 exterior corners—or dodecagonal—12 exterior corners) configured to slidably couple within the first, larger rectilinear tier of the central aperture of clutch plate 38, and a two-tiered, central, therethrough including the hub. A first, largest tier of the central aperture in the distal end portion of the hub may be cylindrical for both receiving the first end portion of clutch spring 40 and the second, intermediate tier of clutch shaft 32. A second, smallest tier of the central aperture may be cylindrical for both stopping the first end portion of clutch spring 40 and receiving the third, smallest tier of clutch shaft 32.

Clutch short spacer 44 may be configured to position clutch assembly 30 to operatively engage with trigger assembly 8, back drive lock assembly 70 as hereinafter described, and idler assembly 90 as hereinafter described. For the exemplary purposes of this disclosure, trigger short spacer 44 may be an annularly cylindrical shaft.

Figure 7:
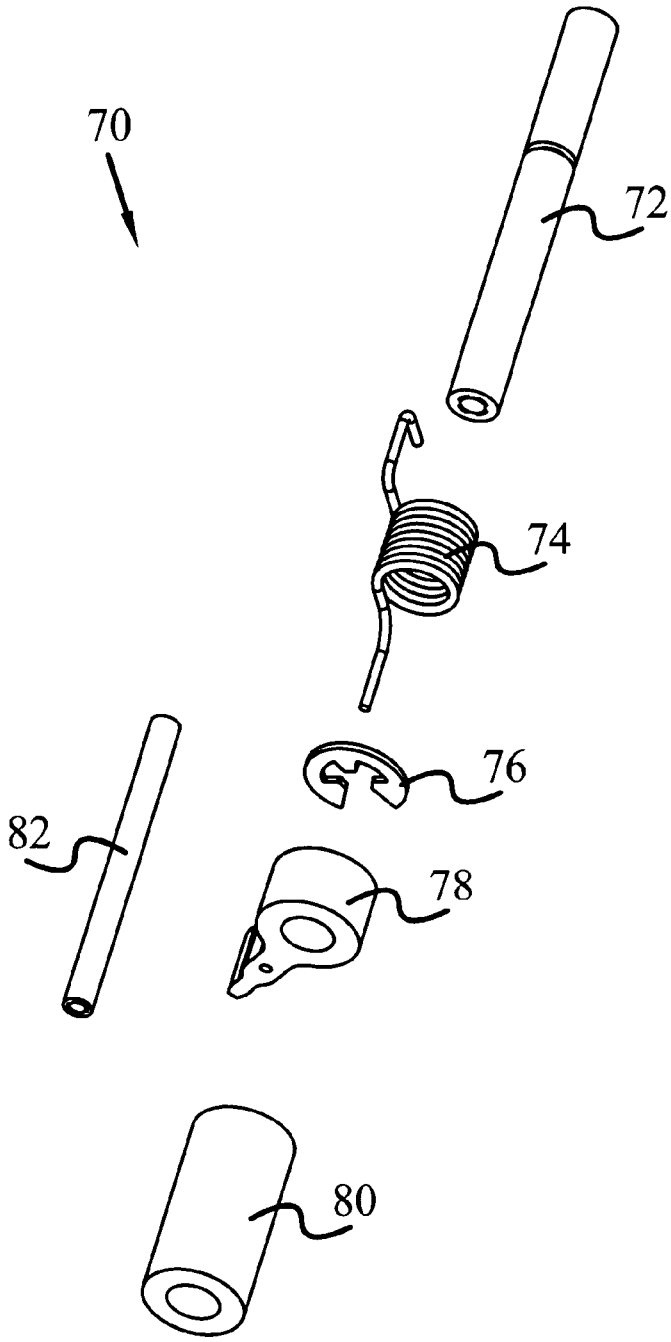
FIG. 7 is an exploded isometric plan view of the back drive lock assembly of FIGS. 2–3.

Back drive lock assembly 70 may be configured to retain geared clutch plate 36 in a fixed position upon rotation of clutch plate 38 in a reverse, disengaged direction (e.g. clockwise) during a return stroke of geared trigger 22, thereby allowing even a relatively free-running fastener to remain stationary during the rotation of clutch plate 38 in a reverse, disengaged direction. As depicted in FIGS. 2–3 and 7, back drive lock assembly 70 may include back drive shaft 72, torsion back drive spring 74, E-clip 76, back drive lock 78, back drive long spacer 80, and back drive stop shaft 82.

Back drive shaft 72 may be configured to receive torsion back drive spring 74, E-clip 76, back drive lock 78, and back drive long spacer 80 so as to retain them in an operative relationship, as well as to allow back drive lock 78 to pivot thereon during drive strokes of geared trigger 22. For the exemplary purposes of this disclosure, back drive shaft 72 may be a cylindrical shaft, a cylindrical shaft with central apertures defined in opposing ends thereof, or an annularly cylindrical shaft, each with a circumferential channel.

Torsion back drive spring 74 may be configured to bias back drive lock 78 against back drive stop shaft 82 and in an engaged position with geared clutch plate 36 after each drive stroke of geared trigger 22. In other words, during each return stroke of geared trigger 22, torsion back drive spring 74 automatically returns back drive lock 78 from its disengaged position to its engaged position. For the exemplary purposes of this disclosure, torsion back drive spring 74 fits over and along back drive shaft 72 and may be close wound with a loop and an opposing protrusion at each end. The protrusion may couple within a cylindrical aperture of back drive lock 78 and the loop may couple with an internal portion of one of the opposing halves of housing 3.

E-clip 76 may be configured to hold and position back drive lock 78 on back drive shaft 72 in an operative relationship with geared clutch plate 36. For the exemplary purposes of this disclosure, E-clip 76 may be an external, radial retaining ring with three prongs that may be installed vertically toward the center of back drive shaft 72 along its radius into the circumferential channel of back drive shaft 72. The portion of E-clip 76 protruding from the circumferential channel (also called a "shoulder") retains back drive lock 78 in place.

Back drive lock 78 may be any detent configured to pivot on back drive shaft 72 and to limit geared clutch plate 36 from turning in a reverse, disengaged direction during a return stroke of geared trigger 22. For the exemplary purposes of this disclosure, back drive lock 78 may be a pawl comprising an annularly, cylindrical portion and a wedge-shaped portion or a two-tiered nose portion. The annularly, cylindrical portion may be configured to fit over and along back drive shaft 72 and to pivot thereon. The wedge-shaped portion or the two-tiered nose portion each may define a cylindrical aperture for receiving the protrusion of torsion back drive spring 74 and each may be configured to removably engage with the teeth of geared clutch plate 36.

Back drive long spacer 80 may be configured to hold and position back drive lock 78 on back drive shaft 72 in an operative relationship with geared clutch plate 36. For the exemplary purposes of this disclosure, back drive long spacer 80 may be an annularly cylindrical shaft.

Back drive stop shaft 82 may be configured to limit the displacement of back drive lock 78 on back drive shaft 72 during return strokes of geared trigger 22. For the exemplary purposes of this disclosure, back drive stop shaft 82 may be a cylindrical shaft, a cylindrical shaft with central apertures defined in opposing ends thereof, or an annularly cylindrical shaft.

Figure 8:
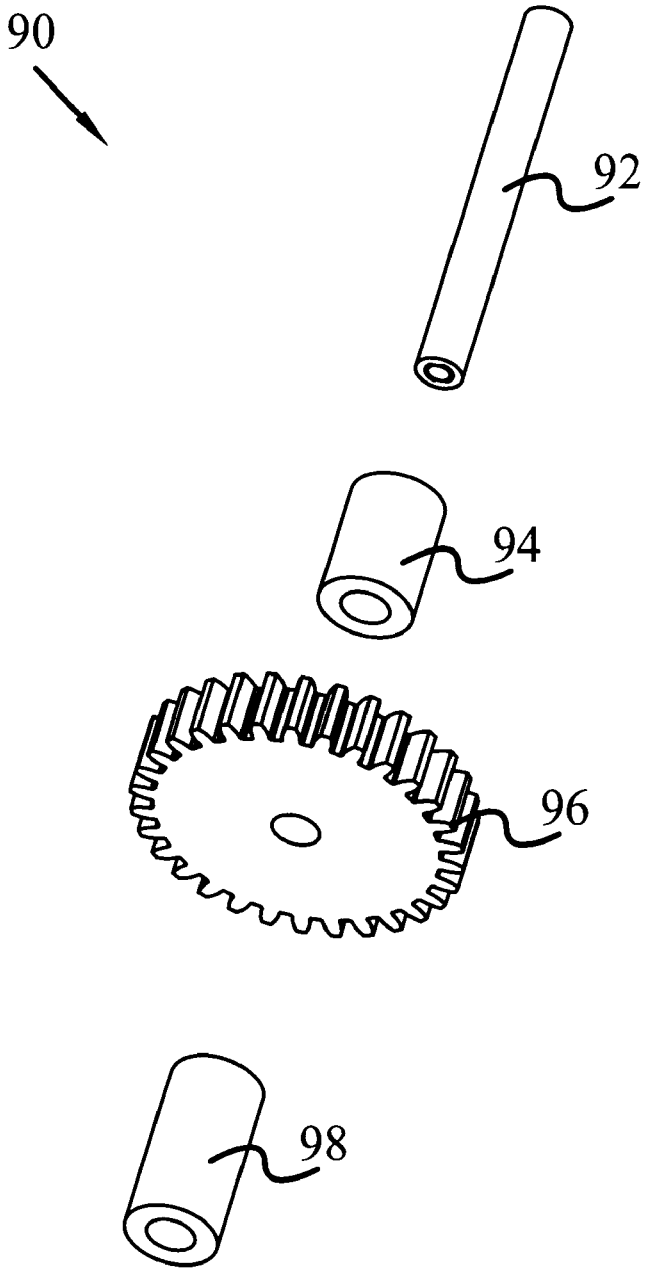
FIG. 8 is an exploded isometric plan view of the idler assembly of FIGS. 2–3.

Idler assembly 90 may be configured to affect the direction of rotation of geared clutch plate 36 (i.e., a driving gear) and spur gear 62 (i.e., a driven gear) of transmission assembly 50 as hereinafter described without affecting the gear ratio between them. As depicted in FIGS. 2–3 and 8, idler assembly 90 may include idler shaft 92, spur gear 96, and idler short and long spacers 94 and 98.

Idler shaft 92 may be configured to receive spur gear 96 and idler short and long spacers 94 and 98 so as to retain them in an operative relationship, as well as to allow spur gear 96 to pivot thereon. For the exemplary purposes of this disclosure, idler shaft 92 may be a cylindrical shaft, a cylindrical shaft with central apertures defined in opposing ends thereof, or an annularly cylindrical shaft.

Spur gear 96 may be configured to both engage with geared clutch plate 36 and spur gear 62 for transmitting motion and driving force during drive strokes of geared trigger 22. That is, spur gear 96 is an intermediate gear placed between geared clutch plate 36 and spur gear 62 to transmit motion and driving force between them. Thus, spur gear 96 causes geared clutch plate 36 and spur gear 62 to rotate in an engaged direction (e.g. counterclockwise). For the exemplary purposes of this disclosure, spur gear 96 may have a central aperture extending therethrough and a diametral pitch of 24, 30 teeth, and a 1.250 inch pitch diameter.

Idler short and long spacers 94 and 98 are each configured to position and hold spur gear 96 in an operative relationship with both geared clutch plate 36 and spur gear 62 of transmission assembly 50 as hereinafter described. For the exemplary purposes of this disclosure, idler short and long spacers 94 and 98 may each be an annularly cylindrical shaft.

Figure 6:
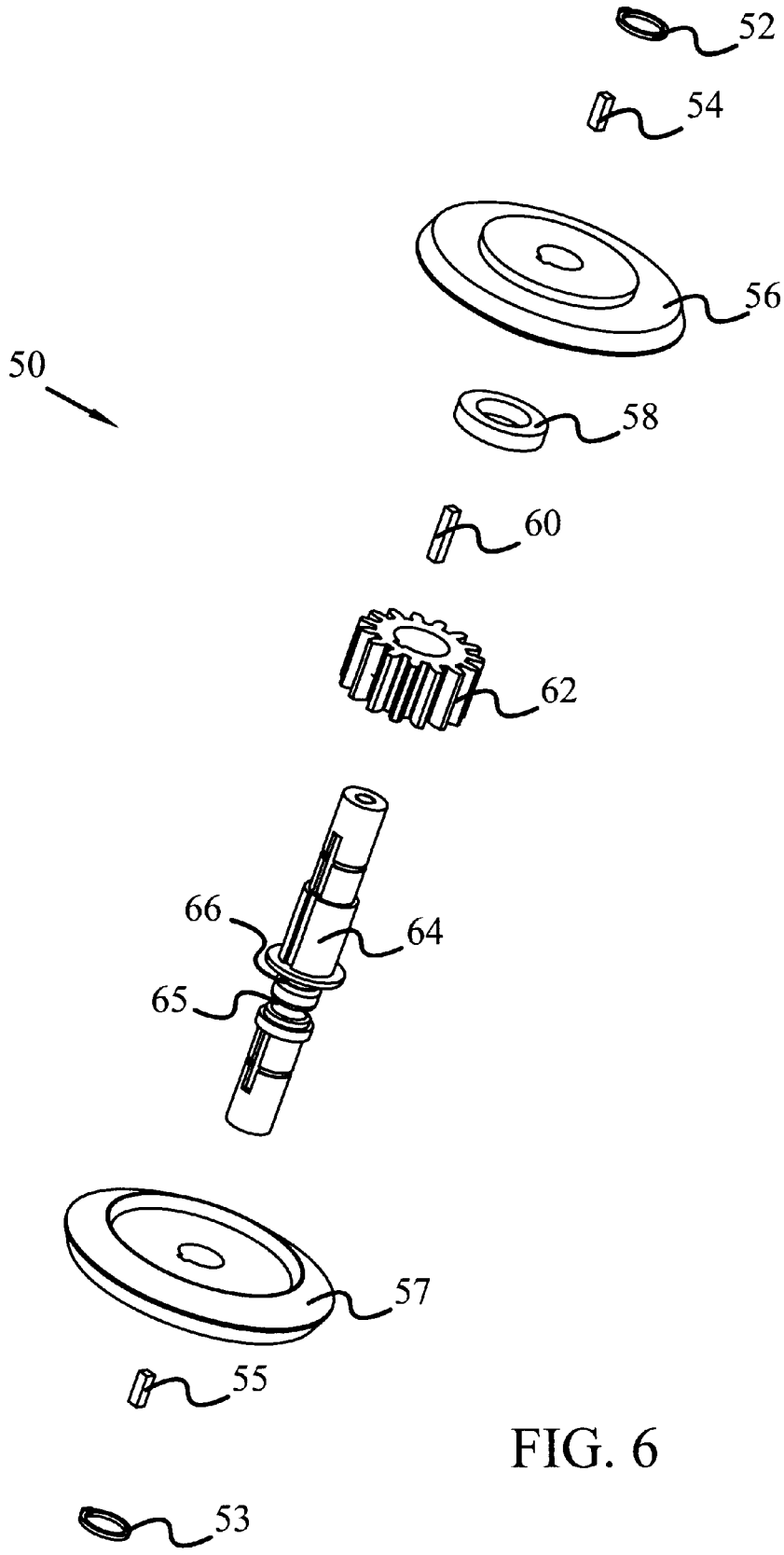
FIG. 6 is an exploded isometric plan view of the transmission assembly of FIGS. 2–3.

Transmission assembly 50 may be configured to both engage with spur gear 96 of idler assembly 90 and bevel gear 102 of drive assembly 100 as hereinafter described for transmitting motion and driving force during drive strokes of geared trigger 22 and to select the desired rotational direction for manipulating fasteners. As depicted in FIGS. 2–3 and 6, transmission assembly 50 may include retaining rings 52 and 53, key ways 54 and 55, bevel gears 56 and 57, transmission spacer 58, key way 60, spur gear 62, and transmission shaft 64.

Retaining rings 52 and 53 may be configured to respectively hold bevel gears 56 and 57 as will hereinafter be described on transmission shaft 64 as will hereinafter be described in an operative relationship. For the exemplary purposes of this disclosure, retaining rings 52 and 53 may each be an external, axial retaining ring such that when they are installed along the center point of transmission shaft 64 into circumferential channels therein as will hereinafter be described, the portions of retaining rings 52 and 53 protruding from the circumferential channels (also called "shoulders") hold bevel gears 56 and 57 in place.

Keys 54, 55, and 60 may each be configured to engage with the keyways of bevel gear 56 and transmission shaft 64, bevel gear 57 and transmission shaft 64, and spur gear 62 and transmission shaft 64 respectively as hereinafter described, thereby coupling bevel gear 56, bevel gear 57, and spur gear 62 on transmission shaft 64 in a fixed relationship. For the exemplary purposes of this disclosure, keys 54, 55 and 60 each may be a rectangular parallelepiped (cuboid).

Bevel gears 56 and 57 may each be configured to engage at a right angle with and transmit motion and driving force to bevel gear 102 of drive assembly 100 as hereinafter described. For the exemplary purposes of this disclosure, bevel gears 56 and 57 may each have a diametral pitch of 24, 36 teeth, and a 1.500 inch pitch diameter. In addition, bevel gears 56 and 57 may each have a central aperture extending therethrough with a keyway. Each central aperture may be cylindrical for receiving transmission shaft 64. Each keyway may be a longitudinal channel for receiving the appropriate key 55 or 56.

Transmission spacer 58 may be configured to position and hold bevel gear 56 and spur gear 62 in operative relationships with bevel gear 102 of drive assembly 100 and spur gear 96 of idler assembly 90 respectively. For the exemplary purposes of this disclosure, transmission spacer 58 may be an annularly cylindrical washer.

Spur gear 62 may be configured to engage with spur gear 96 of idler assembly 90 to rotate in an engaged direction (e.g. counterclockwise). For the exemplary purposes of this disclosure, spur gear 62 may have a diametral pitch of 24, 15 teeth, and a 0.625 inch pitch diameter. In addition, spur gear 62 may have a central aperture extending therethrough with a keyway. The central aperture may be cylindrical for receiving transmission shaft 64. The keyway may be a longitudinal channel for receiving key 60.

Transmission shaft 64 may be configured to laterally slide between alternate positions so as to select the desired rotational direction for manipulating fasteners, and to receive retaining rings 52 and 53, key ways 54, 55 and 60, bevel gears 56 and 57, transmission spacer 58, and spur gear 62 so as to retain bevel gear 56, bevel gear 57, and spur gear 62 thereon in a fixed operative relationship. For the exemplary purposes of this disclosure, transmission shaft 64 may have a first shaft portion and a second shaft portion. The first shaft portion may be a substantially cylindrical shaft portion having: a cylindrical central aperture defined in the end thereof for use by a mechanical fastener in coupling transmission selector puck 68; a keyway (e.g. a longitudinal channel) for receiving key 55; a circumferential channel for receiving retaining ring 53; an integral, external, axial retaining ring for holding bevel gear 57 in place on transmission shaft 64; and circumferential, curvilinear recesses 65 and 66 for removably slidably receiving transmission selector spring 106 as hereinafter described. The second shaft portion may be a two-tiered, cylindrical shaft portion. The smaller tier may have: a cylindrical central aperture defined in the end thereof for use by a mechanical fastener in coupling transmission selector puck 69; a keyway (e.g. a longitudinal channel) for receiving key 54; and a circumferential channel for receiving retaining ring 52. The larger tier is configured to stop bevel gear 56 and may have: a keyway (e.g. a longitudinal channel) for receiving key 60; and an integral, external, axial retaining ring for holding spur gear 62 in place on transmission shaft 64.

Figure 9:
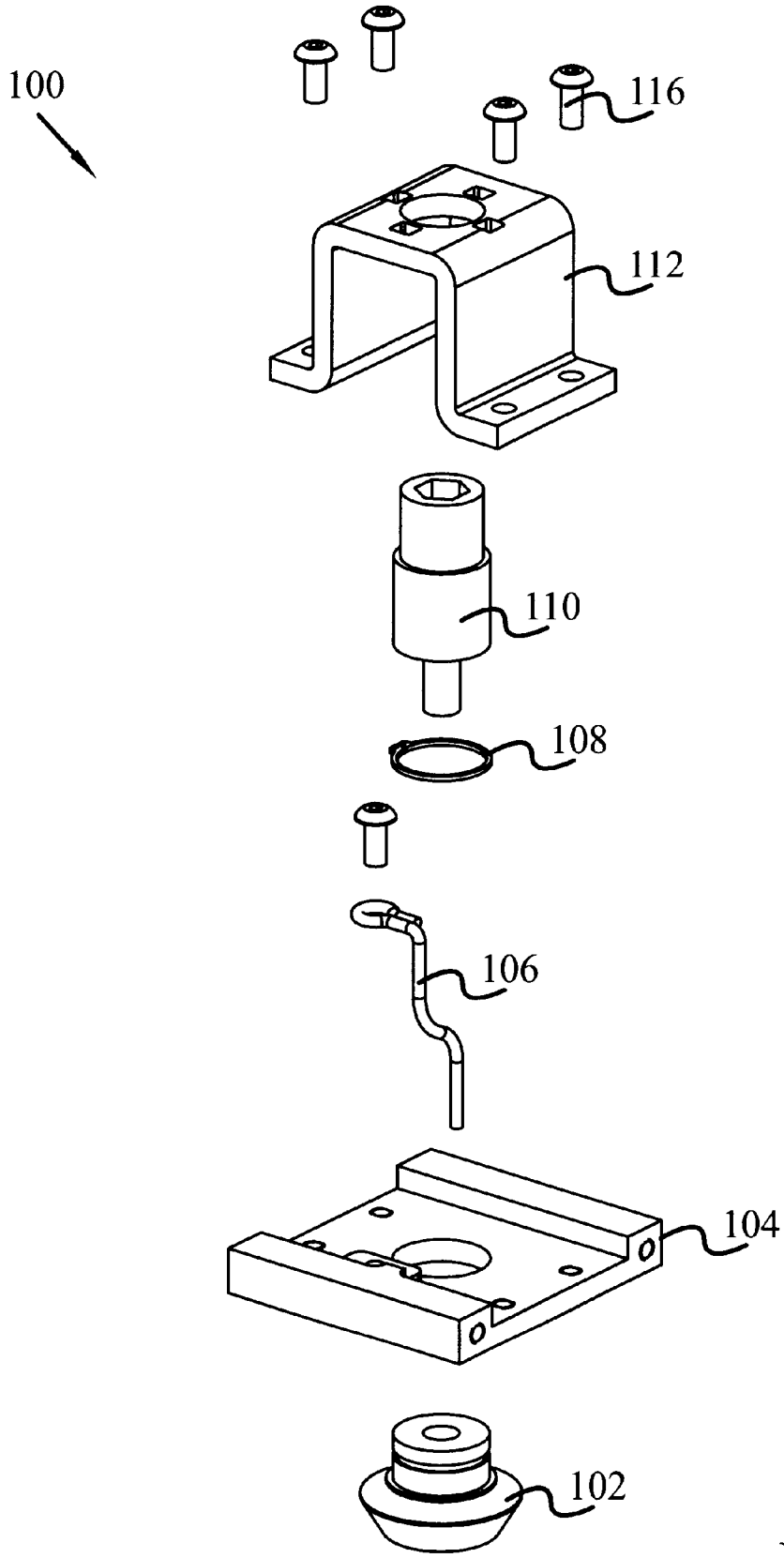
FIG. 9 is an exploded isometric plan view of the drive assembly of FIGS. 2–3.

Drive assembly 100 may be configured to both engage with transmission assembly 50 and any removable attachment tool of the invention as hereinafter described for transmitting motion and driving force to any removable attachment tool. As depicted in FIGS. 2–3 and 9, drive assembly 100 may extend coaxially within barrel portion 4 of housing 3 along its length and may include bevel gear 102, front plate 104, transmission selector spring 106, retaining ring 108, drive puck 110, and holder bracket 112.

Bevel gear 102 may be configured to engage at a right angle with bevel gears 56 and 57 and transmit motion and driving force to drive puck 110 as hereinafter described. For the exemplary purposes of this disclosure, bevel gear 102 may have a diametral pitch of 24, 18 teeth, a 0.750 inch pitch diameter, a hub on the face thereof opposing the teeth, and a central aperture defined in the distal end of the hub. The hub may be cylindrical and may have a circumferential channel in its distal end portion for receiving retaining ring 108. The central aperture may be rectilinear (e.g. polygonal, such as hexagonal—6 interior corners—or dodecagonal—12 interior corners) or curvilinear (e.g. cylindrical) for receiving and coupling the drive tip of drive puck 110 as hereinafter described.

Front plate 104 may be configured to couple with holder bracket 112 and hold both bevel gear 102 and transmission selector spring 106 in operative positions. For the exemplary purposes of this disclosure, front plate 104 may be a rectilinear (e.g. polygonal) channel with a central aperture extending through the bottom of the channel, a transmission selector spring aperture extending through the bottom of the channel, four corner apertures extending through the bottom of the channel, and a projection portion on the bottom of the channel defining an aperture therein. The sides of the channel each may have cylindrical central apertures defined in opposing ends thereof for use by a fastening mechanism in coupling front plate 104 to to opposing side plates of housing 3 or to internal portions of opposing halves of housing 3 as hereinafter described. The central aperture of front plate 104 may be cylindrical for receiving the hub of bevel gear 102 therethrough. The transmission selector spring aperture may be rectilinear (e.g. polygonal) or curvilinear (e.g. obround) aperture for receiving therethrough all of transmission selector spring 106 except for the bent loop. The aperture defined in the projection portion may be for use by a fastening mechanism in coupling the bent loop of transmission selector spring 106 to the projection portion.

Transmission selector spring 106 may be configured to select the desired rotational direction for manipulating fasteners. For the exemplary purposes of this disclosure, transmission selector spring 106 may be substantially Z-shaped with a protrusion for one end portion thereof and a bent loop for the other end portion thereof. Except for the bent loop, all of transmission selector spring 106 may fit through the selector spring aperture in front plate 104 and over bevel gear 102 so that the protrusion may flex and removably slidably fit within circumferential, curvilinear recesses 65 and 66 as transmission shaft 64 is laterally slid between alternate positions, while the bent loop may couple with the projection portion of the back of front plate 104.

Retaining ring 108 may be configured to hold bevel gear 102 adjacent front plate 104 in an operative relationship. For the exemplary purposes of this disclosure, retaining ring 108 is an external, axial retaining ring such that when it is installed along the center point of the hub of bevel gear 102 into the circumferential channel therein, the portion of retaining ring 108 protruding from the circumferential channel (also called a "shoulder") holds bevel gear 102 in place.

Drive puck 110 may be configured to couple with bevel gear 102 and both couple with and transmit motion and driving force to a removable attachment tool of the invention as hereinafter described. For the exemplary purposes of this disclosure, drive puck 110 may have a first drive puck portion and a second drive puck portion. The first drive puck portion may be any suitable rectilinear (e.g. polygonal, such as hexagonal—6 exterior corners—or dodecagonal—12 exterior corners) or curvilinear (e.g. cylindrical) drive tip for inserting and coupling with the central aperture defined in the distal end of the hub of bevel gear 102. The second drive puck portion may be cylindrical puck portion or a two-tiered cylindrical puck portion, each with any suitable rectilinear (e.g. polygonal, such as hexagonal—6 interior corners—or dodecagonal—12 interior corners) or curvilinear (e.g. elliptical) central aperture defined in the distal end thereof for removably receiving a removable attachment tool of the invention.

Figure 10:
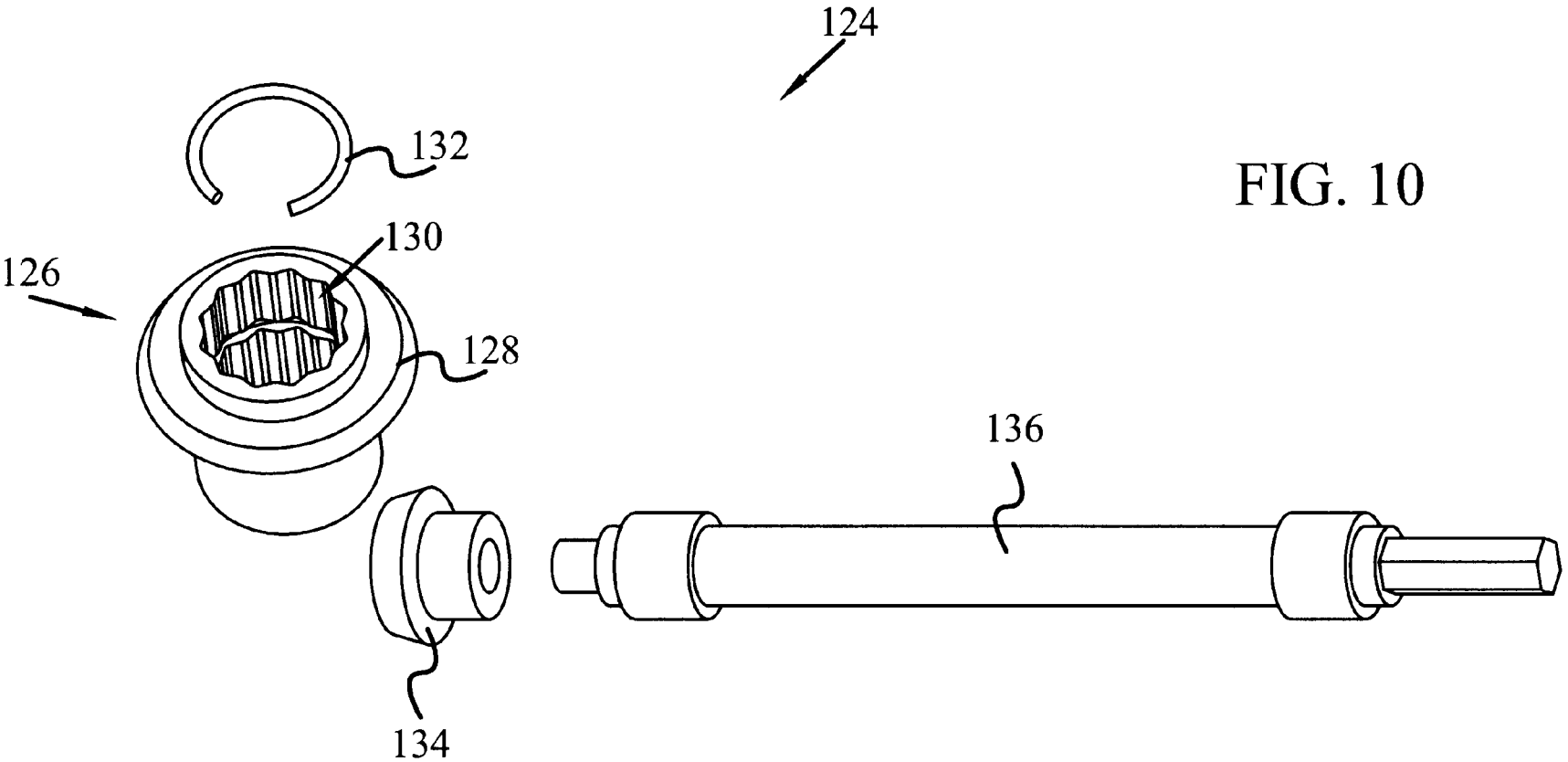
FIG. 10 is an exploded isometric plan view of the wand drive train of FIG. 1.

Holder bracket 112 may be configured to couple with front plate 104 and hold both drive puck 110 and wand housing 122 in operative positions. For the exemplary purposes of this disclosure, holder bracket 112 may be a rectilinear (e.g. square, rectangular, etc.) channel with flanged sides each having a pair of opposing apertures extending through end portions of each of the flanges, a central aperture extending through the bottom of the channel, and at least one aperture adjacent the central aperture and defined by or extending through the bottom of the channel. The opposing apertures extending through end portions of each of the flanges may be cylindrical apertures for use by fastening mechanisms in coupling holder bracket 112 to front plate 104. The central aperture may be cylindrical for receiving the second drive puck portion of drive puck 110 therein or therethrough. The at least one aperture adjacent the central aperture is configured to removably, slidably receive and couple with at least one protrusion of wand assembly 120 as hereinafter described. The at least one aperture may comprise a rectilinear (e.g. polygonal) or curvilinear (e.g. circular or elliptical) aperture, a rectilinear (e.g. polygonal) or curvilinear (e.g. elliptical) aperture that adjacently surrounds the central aperture, an opposing pair of rectilinear (e.g. polygonal) or curvilinear (e.g. circular) apertures, two opposing pairs of rectilinear (e.g. polygonal) or curvilinear (e.g. circular) apertures as depicted in FIG. 10, and the like.

For the exemplary purposes of this disclosure, screws 116 may also be included in drive assembly 100 and are configured to couple transmission selector spring 106 and holder bracket 112 to front plate 104. Notwithstanding, transmission selector spring 106 and holder bracket 112 may be coupled to front plate 104 by any other fastening mechanism, or they may be integrally joined therewith.

In an alternative embodiment of the invention, a drive assembly may comprise an adjustable drive puck, such as a chuck, in place of drive puck 110, the chuck having an adjustable hub or shank opening for accommodating and removably holding various sized hubs or shanks of drive bits, tips, and the like. In other embodiments of the invention, front plate 104 and holder bracket 112 may not be included and internal portions of housing 3 may be used instead to retain the components in operative positions relative to one another.

In addition, screws, such as screws 116 and the like, and/or other mechanical fasteners may be used throughout manually powered drive device assembly 1 to couple various components one with another. For example, transmission selector pucks 68 and 69 may be coupled to opposite ends of transmission shaft 64 screws 116 or other similar screws or mechanical fasteners, although transmission selector pucks 68 and 69 may be coupled therewith by any other fastening mechanism, or they may be integrally joined therewith. As another example, trigger shaft 12, trigger stop shaft 16, clutch shaft 32, back drive shaft 72, back drive stop shaft 82, and idler shaft 92, and front plate 104 may also be coupled with screws 116 or other similar screws or mechanical fasteners to opposing side plates compatible with and coupled to or integral with internal portions of opposing halves of housing 3 or coupled to internal portions of opposing halves of housing 3. Notwithstanding, the aforementioned components may be coupled to opposing side plates or internal portions of opposing halves of housing 3 by any other fastening mechanism, or they may be integrally joined therewith.

A removable attachment tool of the invention may be configured to both manipulate fasteners and at least removably couple with at least one drive (e.g. drive puck or chuck) of at least one drive assembly of a manually-powered drive device of the invention either directly, through extension members, or through a flexible cable for example. Such removable attachment tools, when coupled with at least one drive of at least one drive assembly, transmit the motion and driving force generated initially by squeezing a trigger assembly to the particular fastener which is being manipulated. Notwithstanding, such removable attachment tools may also be detached from the at least one drive puck or chuck of a manually-powered drive device of the invention and may alternatively be used with a separate electrically or pneumatically driven tool, such as a power drill or impact wrench for example.

Accordingly, although the invention may be readily adapted to a variety of embodiments of a removable attachment tool, with reference to FIGS. 1—3 and 10, wand assembly 120 is one example of a removable attachment tool of the invention. Generally, wand assembly 120 may comprise wand housing 122 having a substantially internal drive train 124.

Wand housing 122 may be configured to substantially enclose drive train 124 and to impart flexibility in the manipulation of fasteners at locations that are difficult to access (e.g. wand housing 122 does not require movement during operation to manipulate a fastener). For the exemplary purposes of this disclosure, wand housing 122 may be an elongate, hollow housing that comprises a hollow boxlike portion defining one end thereof and an elongate, rectilinear (e.g. square) or curvilinear (e.g. circular) tubular portion that projects outwardly from the boxlike portion and defines the other end thereof.

The hollow boxlike portion may be configured to substantially enclose and retain box end wrench drive assembly 126 in an operative position, and may be defined by generally spaced and substantially parallel top and bottom walls coupled to or integrally joined with a peripheral side wall, whereby the boxlike portion defines an interior chamber. The top and bottom walls may further include coaxially aligned and opposing circular openings respectively formed therein for rotatably supporting the opposite axial ends of the elongate sleeve of bevel gear 128 of box end wrench drive assembly 126. The boxlike portion, and therefore box end wrench drive assembly 126, may be at an angle from a longitudinal lower axis of the elongated tubular portion of approximately 0° to 90°, such as approximately 10° to 30° for example. Angling the boxlike portion, and therefore box end wrench drive assembly 126, further imparts flexibility in the manipulation of fasteners, as well as allows an operator to more readily retain box end wrench drive assembly 126 on and exert more force on the head of a fastener (e.g. a screw, nut, or bolt head) during manipulation than would otherwise be available with no inclination of the boxlike portion.

The elongate tubular portion may have an elongate interior cylindrical wall that extends longitudinally of the elongate tubular portion in intersecting relationship with the interior chamber defined by the hollow boxlike portion. The inner end of the tubular portion projects through the peripheral side wall of the boxlike portion for providing open communication between the tubular portion and the boxlike portion, with the tubular portion being suitably coupled to or integrally joined with the boxlike portion. The outer end of the tubular portion may include at least one protrusion adjacent an outer opening of the interior cylindrical wall that may be configured to removably, slidably insert and couple with the at least one aperture adjacent the central aperture of holder bracket 112 to inhibit wand housing 122 from rotating. The at least one protrusion may comprise a rectilinear (e.g. cuboidal) or curvilinear (e.g. cylindrical) protrusion, a rectilinear (e.g. cuboidal) or curvilinear (e.g. cylindrical) protrusion that adjacently surrounds at least a substantial portion of the outer opening of the interior cylindrical wall, an opposing pair of rectilinear (e.g. cuboidal) or curvilinear (e.g. cylindrical) protrusions, two opposing pairs of rectilinear (e.g. cuboidal) or curvilinear (e.g. cylindrical) protrusions, and the like. The tubular portion may also serve as a handle if an operator is using wand assembly 120 separately from a manually-powered drive device of the invention.

Internal drive train 124 may substantially disposed within wand housing 122. For the exemplary purposes of this disclosure, internal portions of wand housing 122 may couple with or be integrally joined with portions of various components of drive train 124 to retain drive train 124 in an operative position within housing 122. For the exemplary purposes of this disclosure, internal drive train 124 may comprise box end wrench drive assembly 126, bevel gear 134, and drive shaft 136.

Box end wrench drive assembly 126 may be configured to mount substantially within the interior of the boxlike portion of wand housing 122. For the exemplary purposes of this disclosure, box end wrench drive assembly 126 may include bevel gear 128, drive opening 130, and spring clip 132.

Bevel gear 128 may be configured to engage at any angle with bevel gear 134 as hereinafter described and transmit motion and driving force to a fastener. For the exemplary purposes of this disclosure, bevel gear 128 may have a diametral pitch of 48, 60 teeth, a 1.250 inch pitch diameter. Bevel gear 128 may further include a concentric, cylindrical, elongate sleeve therethrough that extends generally perpendicularly between the top and bottom walls of the boxlike portion of wand housing 122, the opposite axial ends of the elongate sleeve rotatably supported by the coaxially aligned and opposing circular openings formed in the boxlike portion. Suitable shoulders may be defined by the elongate sleeve and may be positioned adjacent the respective top and bottom walls of the boxlike portion to maintain proper rotatable support and position of bevel gear 128 within the boxlike portion.

Drive opening 130 defined by the elongate sleeve of bevel gear 128 may be configured to removably couple with a fastener or any drive bit as hereinafter described. For the exemplary purposes of this disclosure, drive opening 130 may be any suitable rectilinear (e.g. polygonal, such as hexagonal—6 interior corners—or dodecagonal—12 interior corners), central, through aperture with a circumferential recess therein for receiving spring clip 132 as hereinafter described.

Spring clip 132 may be configured to removably hold and position any fastener or any drive bit as hereinafter described within drive opening 130 in an operative relationship. For the exemplary purposes of this disclosure, spring clip 132 may be an internal, axial retaining ring that is installed along the center point of drive opening 130 into the circumferential channel therein.

Accordingly, a variety of wand assemblies 120 may be provided, each having a differently sized drive opening 130 so that each wand assembly 120 may be used directly to manipulate a differently sized fastener such as nut or bolt head for example. Notwithstanding, for the exemplary purposes of this disclosure, drive opening 130 of wand assembly 120, as depicted in FIG. 1, may removably couple with socket drive bit 138 by axially slidably inserting the drive hub of socket drive bit 138 into drive opening 130, which insertion can occur from either the top wall or the bottom wall of the boxlike portion of wand housing 122 due to the coaxially aligned and opposing circular openings formed in the boxlike portion and through drive opening 130. Socket drive bit 138 may be of the type having a through opening so as to permit an elongate threaded rod for example to project therethrough if necessary. However, wand assembly 120 may alternatively couple with a Philips drive bit, a square drive bit, a slot drive bit, a star drive bit, an Allen drive bit, a hexagonal drive bit, an off-set drive bit, a Pozi drive bit, a Torx® drive bit, a clutch drive bit, cup-hook eyelet drive bit, any other like drive bit as known to those of ordinary skill in the art, and any double-end drive bit combination thereof to manipulate corresponding fasteners. Additionally, these drive bits may also have a variety of different hub or shank sizes, such as approximately ¼" to approximately ¾" for example or their metric equivalents.

Bevel gear 134 may be configured to engage with bevel gear 128 and transmit motion and driving force to box end wrench drive assembly 126. For the exemplary purposes of this disclosure, bevel gear 134 may have a diametral pitch of 48, 30 teeth, a 0.625 inch pitch diameter, a hub on the face thereof opposing the teeth, and a central aperture defined in the distal end of the hub. The hub may be cylindrical and the central aperture may be any suitable rectilinear (e.g. polygonal, such as hexagonal—6 interior corners—or dodecagonal—12 interior corners) or curvilinear (e.g. cylindrical) central aperture for receiving and coupling the drive tip of the inner end portion of drive shaft 136 as hereinafter described.

Drive shaft 136 may be configured to extend coaxially within the elongate tubular portion of wand housing 122 along its length. For the exemplary purposes of this disclosure, drive shaft 136 may include an outer end portion, a central portion, and an inner end portion. The outer end portion of drive shaft 136 may comprise a three-tiered shaft. The first, largest tier may be cylindrical and configured to abut against an outer internal portion(s) (e.g. integral sleeve bearing(s)) of wand housing 122 to retain drive shaft 136 in an operative position within wand housing 122. The second, intermediate tier may be cylindrical and configured to be supportably received by the outer internal portion(s) of wand housing 122 to allow drive shaft 136 to freely rotate thereon. The third, smallest tier may be any suitable rectilinear (e.g. polygonal, such as hexagonal—6 exterior corners—or dodecagonal—12 exterior corners) or curvilinear (e.g. elliptical) drive tip configured for inserting and coupling with the central aperture defined in the distal end of the second drive puck portion of drive puck 110 or the hub or shank opening of a chuck. The central portion of drive shaft 136 may comprise an elongate cylindrical shaft. The inner end portion of drive shaft 136 may comprise a cylindrical, three-tiered shaft. The first, largest tier may be configured to abut against an inner internal portion(s) (e.g. integral sleeve bearing(s)) of wand housing 122 to retain drive shaft 136 in an operative position within wand housing 122. The second, intermediate tier may be configured to be supportably received by the inner internal portion(s) of wand housing 122 to allow drive shaft 136 to freely rotate thereon. The third, smallest tier may be any suitable rectilinear (e.g. polygonal, such as hexagonal—6 interior corners—or dodecagonal—12 interior corners) or curvilinear (e.g. cylindrical) drive tip configured for inserting and coupling with the central aperture defined in the distal end of the hub of bevel gear 134.

Figure 11:
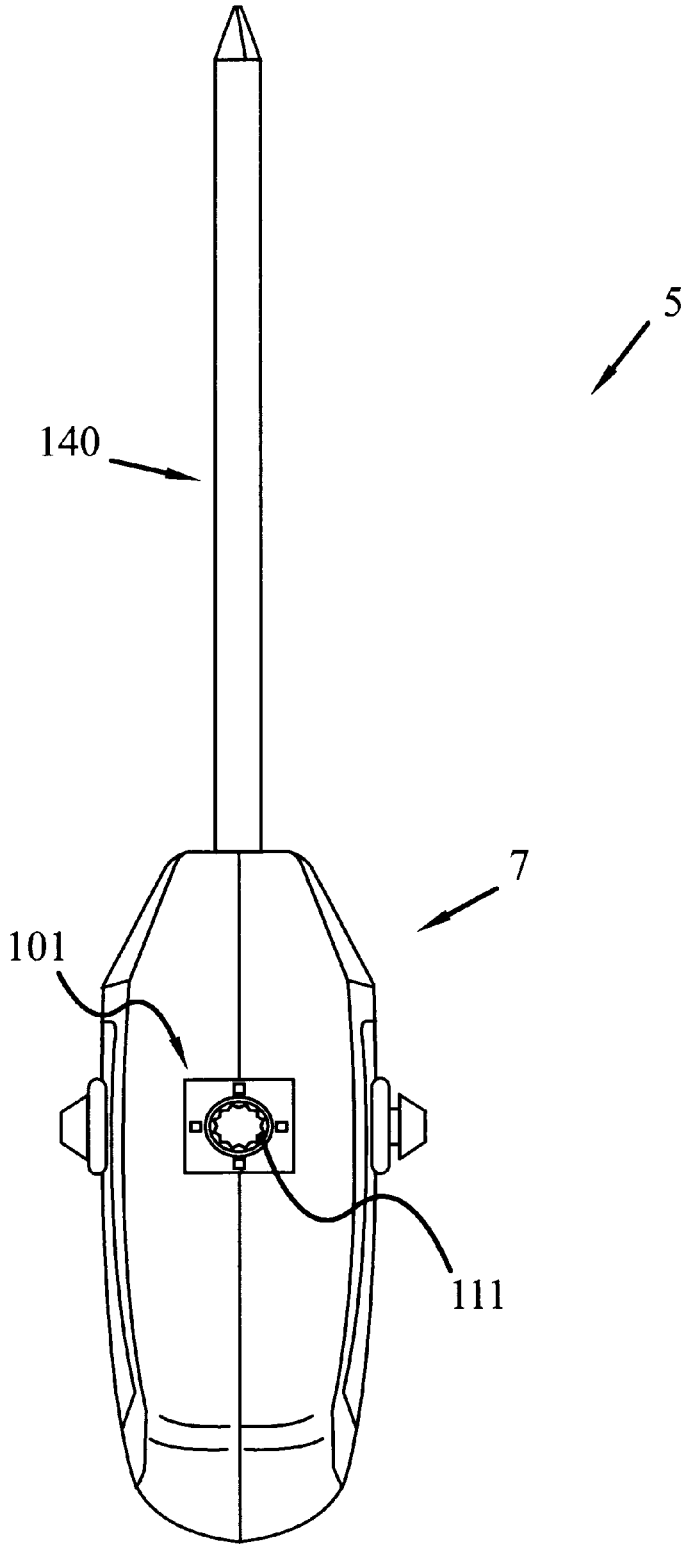
FIG. 11 is a top plan view of another manually-powered drive device assembly including a manually-powered drive device embodiment of the invention and a removable driver bit in operative conjunction with one another.

Alternatively, any drive bit alone is another example of a removable attachment tool of the invention. Accordingly, as depicted in FIG. 11, the removable attachment tool may comprise a Philips drive bit. However, the removable attachment tool may also comprise a square drive bit, a slot drive bit, a star drive bit, an Allen drive bit, a hexagonal drive bit, a socket drive bit as previously described, an off-set drive bit, a Pozi drive bit, a Torx® drive bit, a clutch drive bit, cup-hook eyelet drive bit, any other like drive bit as known to those of ordinary skill in the art, and any double-end drive bit combination thereof.

Alternatively, a chuck is another example of a removable attachment tool of the invention. A chuck may couple to drive assembly 100 for example and may comprise an adjustable hub or shank opening for accommodating and removably holding various sized hubs or shanks of drive bits such as those described previously.

A variety of manually-powered drive device embodiments of the invention and a variety of removable attachment tool embodiments of the invention as heretofore described may be placed in operative conjunction with one another so as to form a variety of manually-powered drive device assembly embodiments of the present invention. For example, FIGS. 1–3 are side plan and top plan views respectively of one embodiment of a manually-powered drive device assembly of the invention. For the exemplary purposes of this disclosure, manually-powered drive device assembly 1 may include manually-powered drive device 2 as previously described and removable wand assembly 120 as previously described in operative conjunction with one another. Wand assembly 120, or any drive bit for that matter, when removably coupled with drive puck 110 of drive assembly 100, transmits the motion and driving force generated initially by squeezing trigger assembly 8 to the particular fastener which is being manipulated.

FIG. 11 is a top plan view of an alternate embodiment of a manually-powered drive device assembly of the invention. Only the principal differences between manually-powered drive device assembly 5 in FIG. 11 and manually-powered drive device assembly 1 in FIGS. 1–3 will be described. For the exemplary purposes of this disclosure, manually-powered drive device assembly 5 may include manually-powered drive device 7 and Philips drive bit 140 in operative conjunction with one another. Manually-powered drive device 7 is similar to manually-powered drive device 2 as previously described, but also includes drive assembly 101 in addition to drive assembly 100. Drive assembly 101 may be similar to drive assembly 100 as previously described or may comprise any other suitable components or configuration as known and understood by those of ordinary skill in the art provided that the components and configuration selected are consistent with the intended mechanical operation of a manually-powered drive device of the invention. For example, a bevel gear of drive assembly 101 may be configured to operatively engage at a right angle with opposing bevel gears of a transmission assembly, and drive assembly 101 may extend in the intermediate frame or receiver portion of the housing, or adjustably extend in the intermediate frame or receiver portion of the housing by a ratcheting mechanism or any other mechanism known in the art, between any acute angle and any obtuse angle to drive assembly 100. Notwithstanding, as depicted in FIG. 11 and for the exemplary purposes of this disclosure, drive assembly 101 may extend substantially perpendicular t o drive assembly 100 and may include drive puck 111 similar to drive puck 100. Philips drive bit 140, or any other bit or wand assembly 120 for that matter, when removably coupled with either drive puck 110 of drive assembly 100 or drive puck 111 of drive assembly 101, transmits the motion and driving force generated initially by squeezing the trigger assembly to the particular fastener which is being manipulated. Furthermore, the twin drive assemblies 100 and 101 of manually-powered drive device 5 may allow, for example, wand assembly 120 to be removably coupled therewith in a plurality of orientations to facilitate the installing and removing of fasteners in a variety of places, orientations, and applications.

The components defining any manually-powered drive device or wand assembly embodiment of the invention may be formed of any of many different types of materials or combinations thereof that can readily be formed into shaped objects provided that the components selected are consistent with the intended mechanical operation of a manually-powered drive device or wand assembly embodiment of the invention. For example, the components may be formed of rubber, composites, polymers, polycarbonates, ABS, polystyrenes, GE Plastics Cycoloy, nylon, any combination thereof, and/or other like materials, metals, such as zinc, magnesium, copper, iron, steel, any combination thereof, and/or other like materials, alloys, such as aluminum, and/or other like materials, any other suitable material, and/or any combination thereof.

The components defining any manually-powered drive device or wand assembly embodiment of the invention may be purchased pre-manufactured or manufactured separately and then assembled together. If any of the components of any manually-powered drive device or wand assembly embodiment are manufactured separately, they may then be coupled with one another in any manner known in the art, such as with adhesive, a weld, a fastener, any combination thereof, and/or the like for example, depending on, among other considerations, the particular material forming the components. However, the components may be purchased pre-manufactured or manufactured simultaneously and integrally joined with one another. Manufacture of these components separately or simultaneously may involve either extrusion, injection molding, casting, milling, or the like. Other possible steps might include sand blasting, polishing, and/or powder coating the components.

For example, housing 3 may comprise twin, substantially vertical, right and left halves that may be integrally joined to one another, or that may be distinct portions coupled together. Likewise, wand housing 122 may comprise twin, substantially horizontal, upper and lower halves that may be integrally joined to one another, or that may be distinct portions coupled together. Alternatively, wand housing 122 may comprise a substantially upper, inverted channel-shaped or conduit-shaped portion and a substantially lower, plate portion that may be integrally joined to one another, or that may be distinct portions coupled together. Bevel gear 134 and drive shaft 136 of wand assembly 120 may be integrally joined to one another. Nevertheless, bevel gear 134 and drive shaft 136 may be distinct portions coupled together. Similarly, bevel gear 102 and drive puck 110 may be distinct portions to be coupled together as depicted in FIG. 9 and described above, or may be integrally joined to one another.

Describing the use of manually-powered drive device assembly embodiments of the invention further and for the exemplary purposes of this disclosure, reference is made to FIGS. 2 and 3, in which manually-powered drive device assembly 1 is depicted in side and top plan views respectively. Generally, manually-powered drive device 2 serves to convert squeezing motion and driving force initiated by trigger assembly 8 into motion and driving force that is transmitted throughout the remainder of the drive train. Removable wand assembly 120, which may be coupled at one end with drive assembly 100 and at the other end with socket drive bit 138 or any other drive bit, transmits the motion and driving force received from the drive train to manipulate a particular fastener.

More particularly, wand assembly 120 may be directly, removably coupled with drive assembly 100. Next, socket drive bit 138 of FIG. 1 may then be removably coupled within drive opening 130 by axially slidably inserting the drive hub of socket drive bit 138 into drive opening 130. Thus, the drive axis of drive assembly 100 extends at a substantially perpendicular angle to the drive axis of socket drive bit 138, rather than being aligned therewith. This can greatly increase accessibility, as well as the convenience of operating manually-powered drive device 2.

Thereafter, transmission shaft 64 may be laterally slid into the position representing the desired direction of rotation of box end wrench drive assembly 126, either clockwise or counterclockwise, for manipulating fasteners. For example and as depicted in FIG. 3, when a clockwise rotational direction of box end wrench drive assembly 126 is desired to install a fastener, an operator presses transmission selector puck 69 to laterally slide transmission shaft 64 until transmission selector puck 69 is substantially flush with the surface of housing 3. Simultaneously and automatically, the protruding end portion of transmission selector spring 106 resiliently flexes and removably slidably fits within circumferential, curvilinear recess 65 of transmission shaft 64. Thus, transmission shaft 64 is thereby removably locked into position so that bevel gear 102 of drive assembly 100 is engaged with bevel gear 57 of transmission assembly 50.

The boxlike portion of wand housing 122 then may be moved transversely into a small clearance space which exists adjacent one end of a fastener, thereby enabling socket drive bit 138 to be aligned with the fastener, and then moved axially into engagement with the fastener. Next, geared trigger 22 may be compressed so that its integral, arcuate gear rack effects rotation of clutch assembly 30. The rotatable driving of clutch assembly 30 effects rotation of idler assembly 90, and it in turns effects rotation of transmission assembly 50. The rotatable driving of transmission assembly 50 effects rotation of drive assembly 100, Which then in turn effects rotation of drive shaft 136 and bevel gear 134. The rotatable driving of bevel gear 134 effects clockwise rotation of box end wrench drive assembly 126 and socket drive bit 138 to install the fastener.

When a counterclockwise rotational direction of box end wrench drive assembly 126 is desired to uninstall a fastener, an operator presses transmission selector puck 68 to laterally slide transmission shaft 64 until transmission selector puck 68 is substantially flush with the surface of housing 3. Simultaneously and automatically, the protruding end portion of transmission selector spring 106 resiliently flexes and removably slidably fits within circumferential, curvilinear recess 666 of transmission shaft 64. Thus, transmission shaft 64 is thereby removably locked into position so that bevel gear 102 of drive assembly 100 is engaged with bevel gear 56 of transmission assembly 50. Then, in the same manner as described above, a counterclockwise rotation of box end wrench drive assembly 126 and socket drive bit 138 is effected to uninstall the fastener.

The embodiments and examples set forth herein were presented in order to best explain the invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, unless otherwise specified, any components of the invention indicated in the drawings or herein are given as an example of possible components and not as a limitation.

What is claimed is:

1. A manually-powered drive device comprising:

a pistol-shaped, hollow housing comprising a barrel portion and a hand grip portion separated by an intermediate frame portion, the barrel portion and the hand grip portion extending substantially perpendicularly from one another; and a drive train substantially disposed within the pistol-shaped housing, the drive train configured to transmit motion and driving force and comprising:

a transmission assembly comprising a transmission shaft extending laterally in the intermediate frame portion and comprising first and second circumferential recesses, the transmission shaft configured to laterally slide between alternate positions;

a transmission selector spring comprising a protrusion for one end portion thereof, the protrusion configured to flex and removably slidably couple within the first circumferential recess or the second circumferential recess as the transmission shaft laterally slides between alternate positions, thereby selecting the desired rotational direction for manipulating fasteners; and a trigger assembly comprising:

a geared trigger comprising a spatulate lower portion, an intermediate portion, and an angled upper portion, the spatulate lower portion configured to be gripped by an operators hand, the intermediate portion comprising a first aperture there through, and the angled upper portion comprising an arcuate transverse slot there through and an arcuate gear rack, the geared trigger configured to initiate the motion and driving force during its drive and return strokes;

a torsion trigger spring comprising a first trigger spring end portion configured for coupling with the geared trigger and a second trigger spring end portion configured for coupling with an internal portion of the pistol-shaped housing, the torsion trigger spring configured to bias the geared trigger in a disengaged position after each drive stroke;

a trigger stop shaft extending through the arcuate transverse slot, the trigger stop shaft configured to limit the displacement of the geared trigger between the drive and return strokes; and a trigger shaft extending through the first aperture, the trigger shaft configured to allow the geared trigger to pivot thereon between the drive and return strokes.

2. The manually-powered drive device of claim 1, the drive train further comprising a clutch assembly comprising:

a clutch spur gear comprising a first hub on a face thereof and a second two-tiered, central, aperture through the first hub and the clutch spur gear, a first tier of the second aperture defined in a distal end portion of the first hub, the clutch spur gear configured to couple with the arcuate gear rack for transmitting motion and driving force during the drive strokes;

a clutch plate comprising a second hub, a first annular ring having a plurality of wedge-shaped teeth on a face thereof, and a third two-tiered, central, through aperture extending through the clutch plate and the second hub, a first tier of the third aperture for slidably coupling with the first hub, the clutch plate configured to couple with the clutch spur gear during the drive and return strokes;

a clutch spring comprising a first clutch spring end portion seating within the first tier of the second aperture and against a second tier of the second aperture and a second clutch spring end portion seating against the second tier of the third aperture, the clutch spring configured to bias the clutch plate in a disengaged position after each drive stroke;

a geared clutch plate comprising a spur gear with a second annular ring having a plurality of wedge-shaped teeth on a face thereof and a fourth central, through aperture for receiving the second hub, the geared clutch plate configured to couple with the clutch plate during the drive strokes and to decouple with the clutch plate during the return strokes.

a three-tiered clutch shaft extending through the third aperture, the clutch spring, and the second aperture, a first tier of the clutch shaft stopping the second hub, a second tier of the clutch shaft extending through both the first tier of the second aperture and a second tier of the third aperture defined in a distal end portion of the third hub, a third tier of the clutch shaft extending through the second tier of the second aperture, the clutch shaft configured to allow the clutch spur gear, the clutch plate, and the geared clutch plate to pivot thereon between the drive and return strokes;

the clutch assembly configured to provide a locked driving connection for the geared clutch plate and the clutch plate upon their rotation during the drive strokes and to free the clutch plate for detached relative movement upon its rotation during the return strokes.

3. The manually-powered drive device of claim 2, the drive train further comprising a back drive lock assembly comprising:

a back drive lock comprising an annularly, cylindrical portion and a wedge-shaped portion configured to removably couple with the geared clutch plate, the back drive lock configured to limit the geared clutch plate from turning in a disengaged direction during the return stroke;

a back drive stop shaft configured to limit the displacement of the back drive lock during the return strokes;

a torsion back drive spring comprising a first back drive spring end portion configured for coupling with the back drive lock and comprising a second back drive spring end portion configured for coupling with an internal portion of the pistol-shaped housing, the torsion back drive spring configured to bias the back drive lock against the back drive stop shaft in an engaged position with the geared clutch plate after each drive stroke; and a back drive shaft extending through the annularly, cylindrical portion of the back drive lock, the back drive shaft configured to allow the back drive lock to pivot thereon during the drive strokes;

the back drive lock assembly configured to retain the geared clutch plate in a fixed position upon rotation of the clutch plate during the return strokes.

4. The manually-powered drive device of claim 3, the drive train further comprising an idler assembly comprising:

an idler spur gear comprising a fifth central aperture extending therethrough, the idler spur gear configured to couple with the geared clutch plate for transmitting motion and driving force during the drive strokes; and an idler shaft extending through the fifth central aperture, the idler shaft configured to allow the idler spur gear to pivot thereon; and the transmission assembly further comprising a transmission spur gear comprising a sixth central aperture extending therethrough, the transmission shaft extending through the sixth aperture, the transmission spur gear configured to couple with the idler spur gear to rotate in an engaged direction; and the idler assembly configured to affect the direction of rotation of the geared clutch plate and the transmission spur gear without affecting the gear ratio therebetween.

5. The manually-powered drive device of claim 4, the drive train further comprising at least one drive assembly comprising:

a first bevel gear comprising a third hub on a teeth opposing face thereof and a seventh central aperture defined in a distal end of the third hub; and a drive puck comprising a drive tip for inserting and coupling within the seventh aperture and a puck portion defining an eighth central aperture in the distal end thereof for both removably coupling with and transmitting the motion and driving force to a removable attachment tool; and the transmission assembly further comprising second and third opposing bevel gears each comprising a ninth central aperture extending therethrough, the transmission shaft extending through the ninth apertures, the second and third opposing bevel gears each configured to transmit motion and driving force to the first bevel gear;

the transmission selector spring coupled with the at least one drive assembly; and the transmission spur gear the first circumferential recess, and the second circumferential recess are between the second and third opposing bevel gears.

6. A manually-powered drive device comprising a pistol-shaped, hollow housing comprising a barrel portion and a hand grip portion separated by an intermediate frame portion, the barrel portion and the hand grip portion extending substantially perpendicularly from one another; and a drive train substantially disposed within the pistol-shaped housing, the drive train configured to transmit motion and driving force and comprising:

a first drive assembly extending coaxially in the barrel portion of the housing along a substantial portion of its length;

a second drive assembly extending in the intermediate frame portion between any acute angle and any obtuse angle to the first drive assembly;

a transmission assembly comprising a transmission shaft extending laterally in the intermediate frame portion and comprising first and second circumferential recesses, the transmission shaft configured to laterally slide between alternate positions and to alternately, removably couple with the first drive assembly and the second drive assembly; and a transmission selector spring comprising a protrusion for one end portion thereof, the protrusion configured to flex and removably slidably couple within the first circumferential recess or the second circumferential recess as the transmission shaft laterally slides between alternate positions, thereby selecting the desired rotational direction for manipulating fasteners.

7. The manually-powered drive device of claim 6, the second drive assembly extending in the intermediate frame portion substantially perpendicular to the first drive assembly.

8. A manually-powered drive device assembly comprising:

a manually-powered drive device comprising:

a pistol-shaped, hollow housing comprising a barrel portion and a hand grip portion separated by an intermediate frame portion, the barrel portion and the hand grip portion extending substantially perpendicularly from one another; and a drive train substantially disposed within the pistol-shaped housing, the drive train configured to transmit motion and driving force and comprising:

a transmission assembly comprising a transmission shaft extending laterally in the intermediate frame portion and comprising first and second circumferential recesses, the transmission shaft configured to laterally slide between alternate positions; and a transmission selector spring comprising a protrusion for one end portion thereof, the protrusion configured to flex and removably slidably couple within the first circumferential recess or the second circumferential recess as the transmission shaft laterally slides between alternate positions, thereby selecting the desired rotational direction for manipulating fasteners; and a removable attachment tool removably coupled with the manually-powered drive device, the removable attachment tool configured to transmit the motion and driving force to a fastener for manipulation, the removable attachment tool comprising a removable wand assembly comprising:

a wand housing comprising a hollow boxlike portion and an elongate tubular portion having an inner end in open communication with the boxlike portion, the tubular portion projecting outwardly from the boxlike portion and having an outer end configured to removably couple with the manually-powered drive device; and a wand drive train substantially disposed within the wand housing and comprising:

a box end wrench drive assembly disposed substantially within the boxlike portion of the wand housing in an operative position and configured to transmit the motion and driving force to the fastener for manipulation;

a first bevel gear disposed substantially within the boxlike portion of the wand housing and coupled with the box end wrench drive assembly, the first bevel gear comprising a hub on a face thereof, the distal end of which defining a central aperture, the first bevel gear configured to transmit the motion and driving force to the box end wrench drive assembly; and a drive shaft extending coaxially within and along a length of the elongate tubular portion of the wand housing and comprising an outer end portion removably coupled to the manually-powered drive device and an inner end portion coupled to the central aperture of the first bevel gear, the drive shaft configured to transmit the motion and driving force to the first bevel gear.

9. The manually-powered drive device assembly of claim 8, the boxlike portion at an angle of approximately 5° to approximately 90° from a longitudinal lower axis of the tubular portion.

10. The manually-powered drive device assembly of claim 8, the boxlike portion at an angle of approximately 10° to approximately 30° from a longitudinal lower axis of the tubular portion.

11. The manually-powered drive device assembly of claim 8, the outer end of the tubular portion comprising at least one protrusion configured to removably couple with the manually-powered drive device to inhibit the wand housing from rotating.

12. The manually-powered drive device assembly of claim 8, the box end wrench drive assembly comprising a second bevel gear coupled with the first bevel gear, the second bevel gear comprising an elongate sleeve therethrough defining a drive opening.

13. The manually-powered drive device assembly of claim 12, the second bevel gear comprising a diametral pitch of approximately 48, approximately 60 teeth, and a pitch diameter of approximately 1.250 inches.

14. The manually-powered drive device assembly of claim 8, the first bevel gear comprising a diametral pitch of approximately 48, approximately 30 teeth, and a pitch diameter of approximately 0.625 inches.

15. The manually-powered drive device assembly of claim 8, the outer end portion and the inner end portion of the drive shaft each comprising a large, cylindrical tier configured to abut against an outer internal portion and an inner internal portion respectively of the tubular portion to retain the drive shaft in an operative position, an intermediate, cylindrical tier configured to be supportably received by the outer internal portion and the inner internal portion respectively of the tubular portion to allow the drive shaft to freely rotate thereon, and a small, drive tip tier configured to couple with the at least one drive assembly and the central aperture of the first bevel gear respectively.

16. The manually-powered drive device assembly of claim 8, the removable attachment tool comprising a removable drive bit.

17. The manually-powered drive device assembly of claim 16, the removable drive bit being one of a Philips drive bit, a square drive bit, a slot drive bit, a star drive bit, an Allen drive bit, a hexagonal drive bit, a socket drive bit, an off-set drive bit, a Pozi drive bit, a Torx® drive bit, a clutch drive bit, cup-hook eyelet drive bit, and any double-end drive bit combination thereof.

* * * * *